US006273278B1

(12) United States Patent
Enyedy et al.

(10) Patent No.: US 6,273,278 B1
(45) Date of Patent: Aug. 14, 2001

(54) TACO HOLDER

(75) Inventors: Julie A. D. Enyedy, Chicago; Anne Bucher, Palatine, both of IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/660,758

(22) Filed: Sep. 13, 2000

(51) Int. Cl.[7] ..... A47F 7/00
(52) U.S. Cl. ..... 211/85.4; 211/73; D7/504
(58) Field of Search ..... 211/70.1, 72, 73, 211/85.4, 70.2; D7/504

(56) References Cited

U.S. PATENT DOCUMENTS

| | | | | |
|---|---|---|---|---|
| D. 309,084 | | 7/1990 | Alsup | D7/504 |
| D. 333,408 | | 2/1993 | Fleisher | D7/504 |
| D. 336,014 | * | 6/1993 | Castro | D7/504 |
| D. 350,671 | | 9/1994 | Asner | D7/504 |
| D. 363,413 | | 10/1995 | Smith | D7/504 |
| D. 370,596 | | 6/1996 | Fleisher | D7/504 |
| 1,974,674 | * | 9/1934 | Halladay et al. . | |
| 3,446,416 | | 5/1969 | Epstein | 229/87 |
| 4,181,220 | * | 1/1980 | Zicko . | |
| 4,603,825 | | 8/1986 | Kotliar | 248/174 |
| 4,671,404 | * | 6/1987 | Wall et al. . | |
| 4,746,010 | | 5/1988 | Fournier | 206/45.14 |
| 4,834,328 | * | 5/1989 | Hall . | |
| 4,872,566 | | 10/1989 | Alsup | 211/13 |
| 4,896,820 | * | 1/1990 | Harrington | 211/73 X |
| 5,005,704 | * | 4/1991 | Martin . | |
| 5,713,462 | * | 2/1998 | Hansen . | |
| 5,971,168 | * | 10/1999 | Proulx | 211/85.4 |

* cited by examiner

*Primary Examiner*—Robert W. Gibson, Jr.
(74) *Attorney, Agent, or Firm*—Fitch, Even, Tabin & Flannery

(57) ABSTRACT

A holder for tacos and the like comprised of semi-rigid material. The holder has a generally triangular configuration, with upwardly convergent first and second side walls extending from a generally horizontal base portion. The two side walls are joined at the top of the holder to form a triangular structure. Upwardly opening slots are formed in the side walls. Each of the slots has a curved base to accommodate tacos. To accommodate individual servings, the holder is separable along a line of weakness. To facilitate incorporation of the holder into a meal kit, in one embodiment, the holder can be folded in a flat configuration with the base folded upward between the side walls.

12 Claims, 4 Drawing Sheets

TACO HOLDER

FIELD OF THE INVENTION

This invention relates generally to a disposable holder for tacos and the like that is suitable for mass production and inclusion in packaging for retail food products.

BACKGROUND OF THE INVENTION

In providing a taco holder for inclusion in retail food product packaging, among the considerations that must be addressed are the ease of assembly and use by the consumer; the efficacy for holding multiple tacos and the like without spillage or breakage during filling and possibly heating; the ability to hold tacos and the like for individualized servings; and the ability of the holder to be efficiently packaged in a retail container. In addition, where a device of this type is intended for use in commercially packaged food products, it should be capable of economical manufacture and incorporation in packages, and should be compatible with high speed packaging lines.

A disadvantage with some holders which provide good structural integrity is that they are expensive to make and not easily collapsible to facilitate packaging in a retail container. Other holders which are inexpensive to make and easy to package may be difficult for the consumer to assemble.

In the past, much effort has been directed toward creating an inexpensive, disposable holder that is both structurally adequate and easy to package in a retail container. For example, U.S. Pat. No. 5,971,168 discloses a holder for multiple taco shells which is disposable, and can be maintained in a flat position prior to use. U.S. Pat. No. 4,746,010 discloses a taco tray which is made by converting the retail container that is used to package food items, such as taco shells.

A disadvantage of prior designs such as those disclosed in the '168 and '010 patents is the difficulty of assembling such units. The design disclosed in the '168 patent requires that in conjunction with forming several folds, several tabs and slots or glue strips must be employed in order to create the finished holder. The '010 patent requires that several perforated sections be removed from the box in order to form the taco holder. Additionally, once the taco holder of the '010 patent is assembled, the box is destroyed, and thus can no longer provide a means to store remaining unused product.

SUMMARY OF THE INVENTION

In accordance with the invention, there is provided a holder for tacos and the like which is structurally adequate to support tacos and the like in an upright position and which is also inexpensive to make, easy to assemble, and readily collapsible to facilitate its incorporation into a retail food package. The taco holder preferably comprises a base portion, a pair of side structures defining a plurality of upwardly opening slots for receiving tacos and the like, and at least one line of weakness situated between two of the slots, so that the holder is separable into two or more holders for individualized servings. Each of the slots has a base portion and a top portion, and is preferably curved at the base.

For incorporation into a retail meal kit, the holder may be preassembled and folded flat. The base of the taco holder may contain a line of weakness that provides a means for folding the base upward so that the holder may be maintained in a flat position prior to use. Alternatively, a flat unfolded blank may be provided in the meal kit, or a blank folded only along the top may be provided.

The assembled taco holder preferably has a generally triangular cross-section, comprising a bottom wall and a pair of upwardly convergent side walls joined along the top. The bottom wall may comprise a pair of overlapping members joined along a longitudinal seam. In one embodiment, the holder may be preassembled and folded in a flat configuration for inclusion in a meal kit, with the bottom wall folded on itself, so that the holder may be shifted to a use position simply by unfolding and flattening the bottom wall. In a second embodiment, one or more flat blanks may be provided in the meal kit and interlocking tabs and slots may be used to place each holder in position for use. In order to assemble the holder of the second embodiment, the user may fold a pair of base walls toward each other and insert the tabs into the slots.

DETAILED DESCRIPTION OF THE PREFERRED EMBODIMENT

Figure 1:
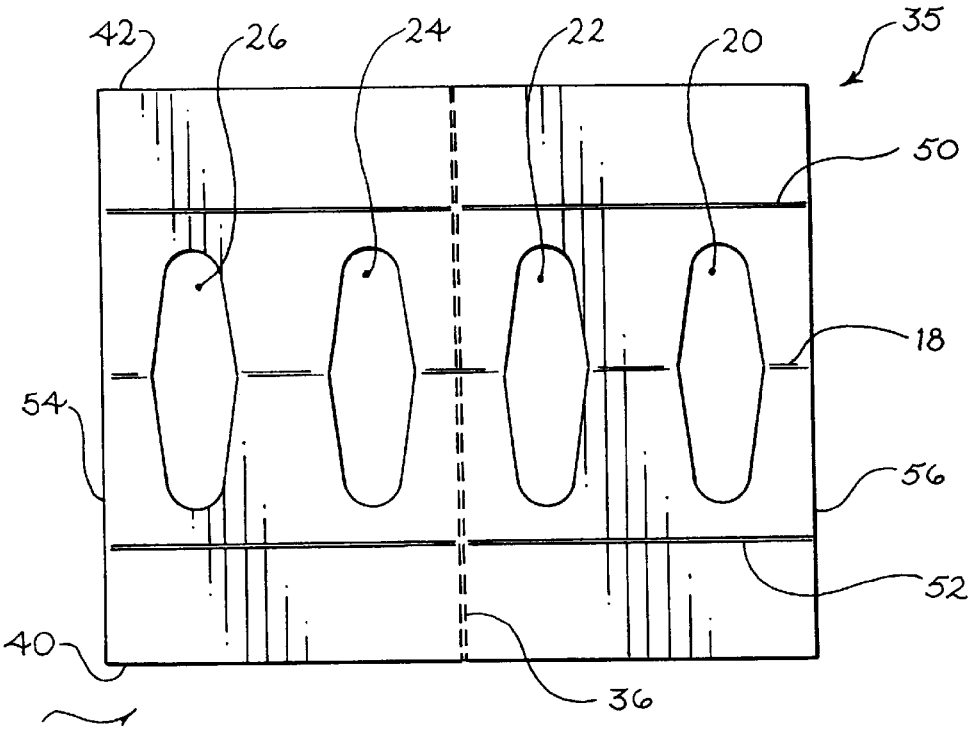
FIG. 1 is a plan view of a taco holder blank in accordance with a first embodiment of the invention.

As shown in the drawings for purposes of illustration, the invention is preferably embodied in a holder 10 formed of semi-rigid material. Virtually any semi-rigid material may be suitable to practice the invention; examples of such materials are various grades of paper or paperboard approved for direct food contact, including, but not limited to solid bleached sulfate, solid unbleached sulfate, recycled paperboard, unbleached kraft, chipboard, or combinations of these or other materials. For added strength and functionality, the paper or paperboard may also be coated with a polymer material. In a preferred embodiment, a recyclable, bleached paperboard with a polymer based coating is used to manufacture the holder. Several types of thermoset rigid plastics approved for direct food contact may be utilized for such coating applications including, but not limited to polystyrene, polyethylene terephthalate, polyethylene, high density polyethylene, polypropylene, polyvinyl chloride, and co-extrusions and laminations of these or other materials. In a preferred embodiment of the invention, a polyethylene coating is used. Although materials of various thickness would be appropriate to practice the invention, in a preferred embodiment the thickness of the paperboard varies between about 0.01 inches and about 0.02 inches, more preferably about 0.015 inches to about 0.018 inches. To achieve adequate stiffness, the thickness of the plastic material should be a minimum of about 0.01 mils.

A rectangular blank 35 for the taco holder in accordance with a first embodiment is drawn to scale in FIG. 1. Although the size of the blank may vary to appropriately accommodate the size of the food article to be placed in the holder, the dimensions of the blank in a preferred embodiment are about 7.75 inches by about 7 inches. The blank contains a plurality of generally elliptical slots or apertures 20, 22, 24, 26 punched therein. The blank contains a central line of weakness 18 and two peripheral lines of weakness 50 and 52 situated along the longitudinal axis of the blank and generally parallel to each other. The side edges of the holder 40 and 42 may be secured together by a strip of adhesive or other suitable means to maintain the holder in place once assembled. A line of weakness 36, located along the transverse axis of the holder, provides a means to separate the holder into two holders for individualized servings. A "line of weakness" as used herein may include any means of weakening or partial removal of material along a line which facilitates easy folding or separation of the material. A line of weakness may be created by any suitable means, including complete removal of segments of material, reduced thickness of a material, weakening by folding, or use of alternate materials with greater pliability.

To assemble the holder from the blank of FIG. 1, folds are made along the lines of weakness 50, 18 and 52. The central line of weakness 18 forms the top of the holder, with the peripheral lines of weakness 50 and 52 situated at opposing sides of the base. The side edges 40 and 42 are secured together by a strip of adhesive such as glue, or double sided tape, or other suitable means, to form a longitudinal seam 44 (see FIG. 3) at the base of the holder. Once the holder is assembled, the apertures 20, 22, 24 and 26 provide a means for holding tacos and the like.

Figure 2:
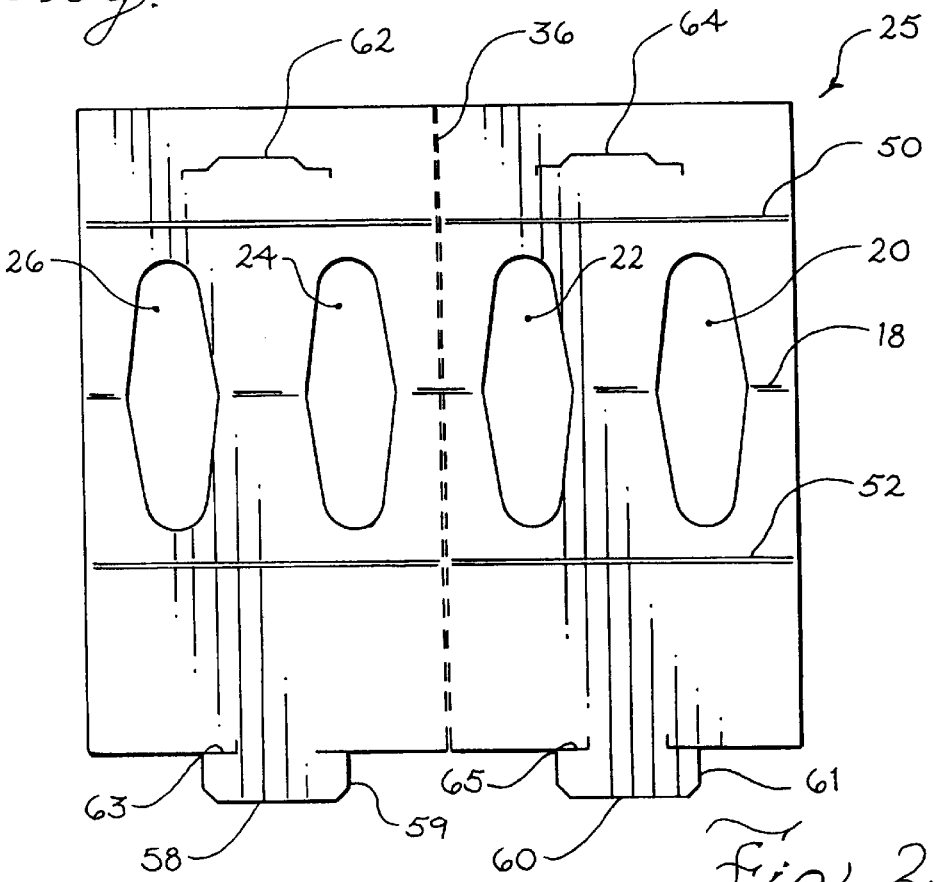
FIG. 2 is a plan view of a taco bolder blank in accordance with a second embodiment of the invention.

FIG. 2 shows a blank 25 for a second embodiment of the invention. The blank depicted in FIG. 2 is similar to that in FIG. 1, except that the side edges of the holder are secured by complementary interlocking means. "Complementary interlocking means" as used herein may include any suitable means for reversibly joining two elements together. Examples of such means are hook and loop fasteners, snaps, zipper means, etc. In a preferred embodiment, the complementary interlocking means are comprised of tabs 58 and 60, and slots 62 and 64. To assemble a holder from the blank of FIG. 2, folds would be made along the lines of weakness 18, 50 and 52 and the tabs 58 and 60 would be inserted into slots 62 and 64, respectively, to secure the holder in place.

Figure 9:
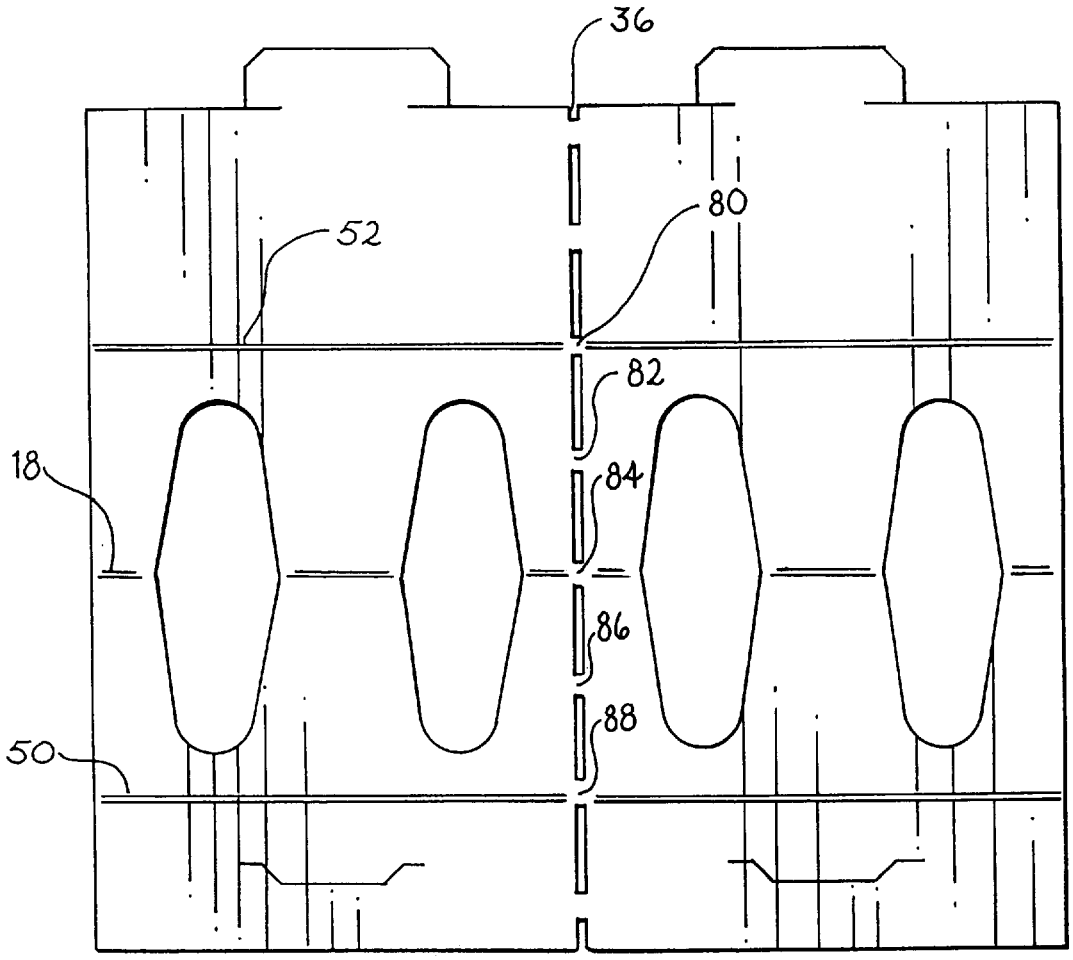
FIG. 9 is a plan view of a taco holder blank in accordance with a third embodiment of the invention.

In a third embodiment of the invention, FIG. 9 is a view of a blank substantially similar to that shown in FIG. 2, except that the line of weakness along which the holder is separable comprises large segments of material removed along the transverse axis of the holder 36. Alternating segments of material 80, 82, 84, 86, and 88 hold the two halves of the holder together. The segments of material 80, 84 and 88 are situated along longitudinal lines of weakness 52, 18 and 50, respectively. Additionally, segments 82 and 86 are located approximately half the distance between adjacent longitudinal lines of weakness 52 and 18, and 18 and 50, respectively.

Figure 3:
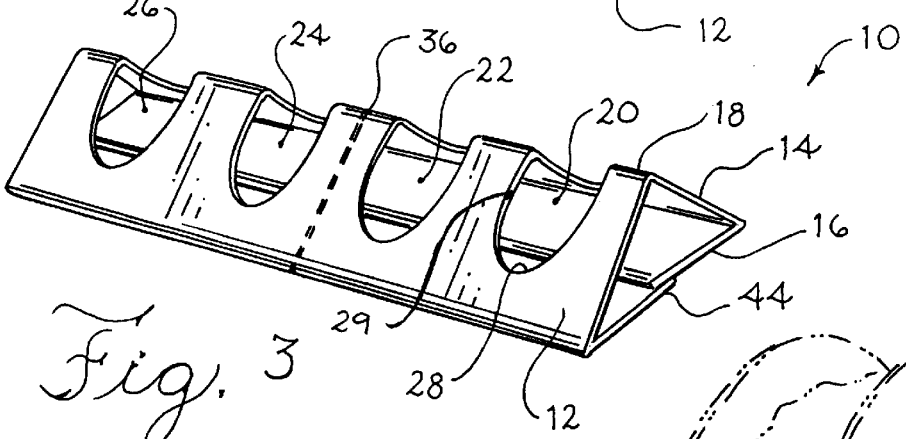
FIG. 3 is a perspective view of an assembled taco holder in accordance with the first embodiment of the invention.
Figure 4:
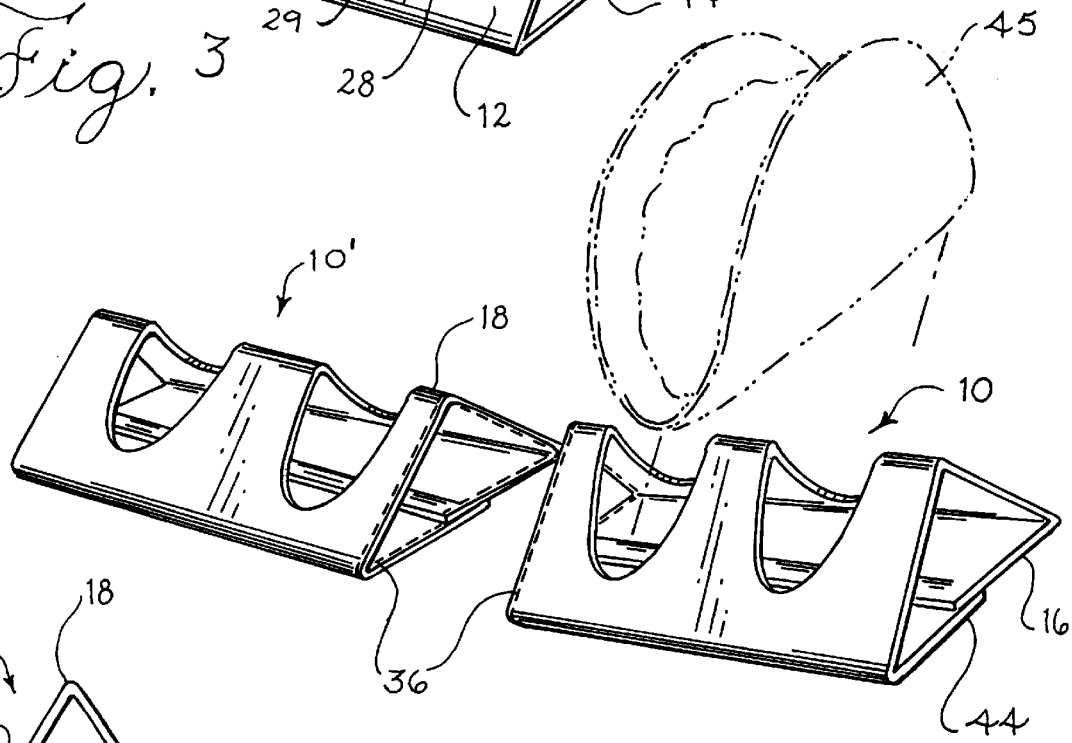
FIG. 4 is a perspective view of an assembled taco holder in accordance with the first embodiment of the invention, showing a taco placed therein. The holder is split at the center to form two holders for individualized servings.
Figure 5:
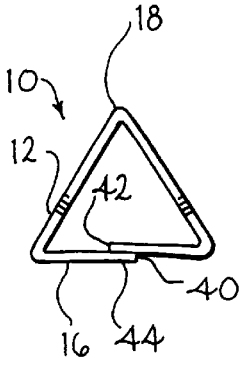
FIG. 5 is a side elevation of an assembled taco holder in accordance with the first embodiment of the invention.

As shown in FIGS. 3–5, which depict a holder made from the blank of FIG. 1, the holder 10 has a generally triangular configuration. That is, the holder 10 comprises upwardly convergent first and second walls 12 and 14 extending from a generally horizontal base portion 16. The side walls 12 and 14 are joined at the top of the holder 18 to form a generally triangular structure with upwardly opening slots 20, 22, 24, and 26 for receiving tacos and the like. Each slot defines a generally u-shaped opening in each of the side walls, comprising a curved base 28 and divergent sides 29 which approximate the profile of a taco 45. Side edges 40 and 42 are overlapped and joined along a longitudinal seam 44 by a strip of adhesive or other means. To accommodate individual servings, the holder is separable along a line of weakness 36 into two holders 10 and 10' for accommodating individualized servings, as shown in FIG. 4.

Figure 7:
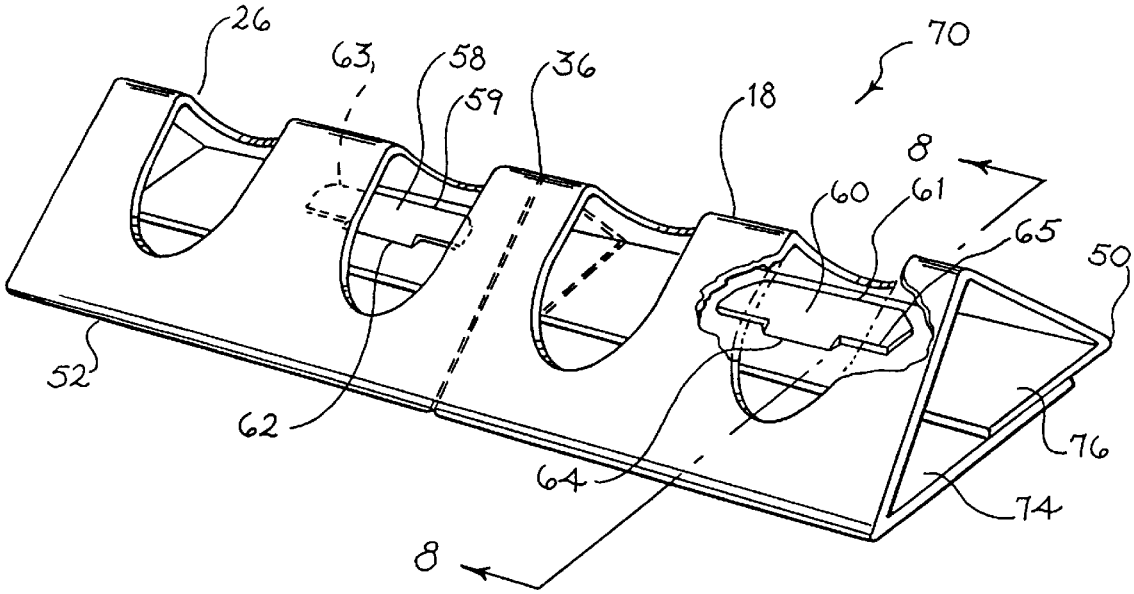
FIG. 7 is a perspective view of an assembled taco holder in accordance with the second embodiment of the invention.
Figure 8:
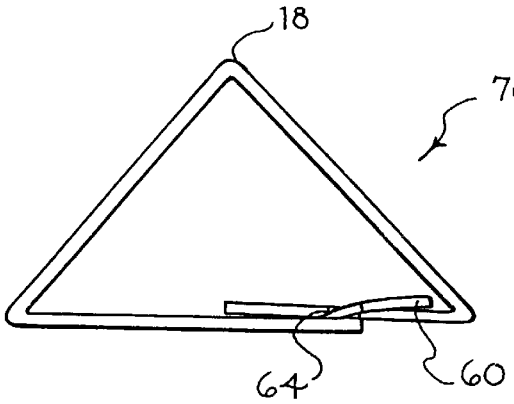
FIG. 8 is a side elevation of an assembled taco holder in accordance with the second embodiment of the invention.

FIG. 7 shows a holder assembled from the blank of FIG. 2. The holder depicted in FIG. 7 is similar in structure to the first embodiment shown in FIG. 3, except that the holder is secured by means of complementary interlocking tabs 58 and 60 and slots 62 and 64. To assemble the holder, from the blank in FIG. 2, folds are made along the lines of weakness 50, 18, and 52, and the tabs 58 and 60 are inserted in the slots 62 and 64, respectively, by linear displacement of the tabs relative to the slots. The heads of the tabs 59 and 61 have a maximum dimension less than the slot width to facilitate entry, and the ears 63 and 65 on the tabs function to lock the tabs in the slots after insertion.

Figure 6:
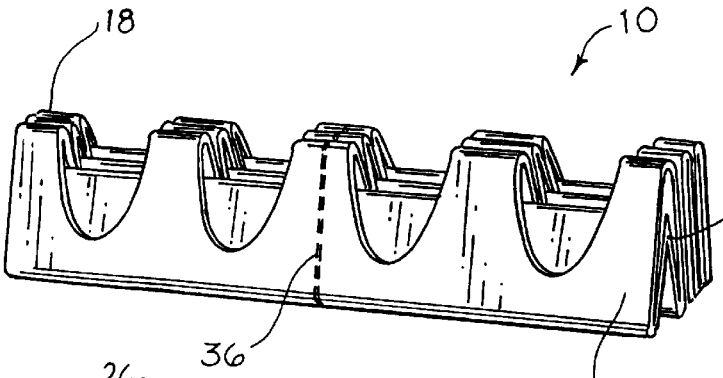
FIG. 6 is a perspective view of three folded taco holders.

The holder may be packaged with and sold as a part of a meal kit for tacos and the like containing non-perishable foods for the preparation of a meal such as tacos, pita bread, seasonings, and sauces. To facilitate the incorporation of one or more holders in a meal kit, the holders may be included in the kits as unfolded blanks, or as blanks folded only about their central lines of weakness, or one or more of the assembled holders can be folded in a flat configuration. FIG. 6 shows three of the holders 10 folded along their central lines of weakness 18 and along a longitudinal center line 44 of the base, allowing the base 16 to be folded between the first and second side walls 12 and 14 (See FIG. 3). Alternatively, the holder might be folded along the central line of weakness 18 with the base members folded down, rather than upward (not shown).

In order for the end user to reconfigure the holder 10 from its folded position as depicted in FIG. 6, the user would simply unfold the base by applying downward force on the longitudinal fold, or by spreading the side walls. Alternatively, the holder may have sufficient resilience to unfold itself when removed from the meal kit. To assemble the holder, as shown in FIG. 7 from a blank folded along its center line 18, the user would simply fold the base walls 74 and 76 toward each other and insert the tabs into their respective slots.

While the invention has been described in conjunction with a specific embodiment, various alternatives, modifications, and variations will be apparent to those skilled in the art in light of the foregoing description.

What is claimed is:

1. A blank for assembly into a holder for tacos and the like, comprising:

a substantially rectangular sheet formed of semi-rigid material having a central longitudinal axis, a central transverse axis perpendicular to said central longitudinal axis, a pair of end edges generally parallel to said transverse axis and a pair of side edges generally parallel to said longitudinal axis;

a first line of weakness along said central longitudinal axis;

second and third lines of weakness along said sheet, said second and third lines of weakness being generally parallel to and on opposing sides of said first line of weakness;

a plurality of generally elliptical apertures, said apertures being situated lengthwise about the central longitudinal axis and said apertures located between said second and third lines of weakness;

at least one transverse line of weakness situated generally parallel to said transverse axis, said at least one transverse line of weakness being between two of said apertures; and means for joining said side edges;

said holder being configured so that when the sheet is folded along the longitudinal lines of weakness, and the side edges are joined, the sheet forms a substantially triangular structure wherein the apertures provide receptacles for holding tacos and the like, wherein said sheet is separable along said at least one transverse line of weakness, so that it may form two or more holders for individualized servings.

2. A blank for assembly into a holder for tacos and the like, comprising:

a sheet formed of semi-rigid material having a central longitudinal axis, a central transverse axis perpendicular to said central longitudinal axis, a pair of end edges generally parallel to said transverse axis, and a pair of side edges generally parallel to said longitudinal axis;

a first line of weakness along said central longitudinal axis;

second and third lines of weakness along said sheet, said second and third lines of weakness being generally parallel to and on opposing sides of said first line of weakness;

a plurality of apertures, said apertures being situated about the central longitudinal axis, and said apertures being located between said second and third lines of weakness;

at least one transverse line of weakness situated between said apertures so that when assembled, said holder is separable into two or more holders for individualized servings; and means for joining said side edges;

said holder being configured so that when the sheet is folded along the longitudinal lines of weakness, and the side edges are joined, said sheet forms a structure wherein the apertures provide receptacles for holding tacos and the like.

3. The blank according to claim 2, wherein said side edges are fixedly connected.

4. The blank according to claim 2, further comprising complementary interlocking means for joining said side edges.

5. A blank according to claim 4 wherein said complementary interlocking means comprises a plurality of tabs and slots, each of said tabs comprising a head portion including a pair of ears; wherein the length of each of said slots is greater than the length of said head portion of said tabs, and wherein said ears hold said tabs in a locked position when said tabs are engaged.

6. A blank for assembly into a holder for tacos and the like, comprising, in combination;

a sheet formed of semi-rigid material, said sheet having a pair of side edges:

at least two apertures in said sheet;

means for joining said side edges;

said holder being configured so that when the side edges are joined, said sheet forms a structure wherein the apertures provide receptacles for holding tacos and the like; and at least one transverse line of weakness for separating said apertures, so that said holder may be divided into two or more holders for individualized servings.

7. A holder for tacos and the like, comprising:

a base portion;

a pair of side structures;

a plurality of upwardly opening slots in said side structures; and at least one transverse line of weakness situated between two of said slots so that when assembled, said holder is separable into two or more holders for individualized servings.

8. The holder of claim 7 wherein each of said slots contains a curved base portion and divergent, linear sides extending upward therefrom.

9. The holder according to claim 7, wherein said base portion comprises a line of weakness, where said line of weakness provides a means for folding said base so that said holder may be maintained in a flat, fully-assembled, collapsed position prior to use.

10. A holder according to claim 9 wherein said base portion may be assembled by spreading said side structures.

11. A holder according to claim 9 wherein said base portion has sufficient resilience to unfold into an assembled position when removed from a flat position.

12. A meal kit for tacos comprising in combination:

a holder for tacos comprising, a base portion;

side structures extending upwardly therefrom;

a plurality of upwardly opening slots in said side structures;

at least one transverse line of weakness situated between a pair of said slots so that when assembled, said holder is separable into two or more holders for individualized servings; and taco shells and other taco ingredients.

* * * * *